US005911650A

United States Patent [19]

Cox

[11] Patent Number: 5,911,650

[45] Date of Patent: Jun. 15, 1999

[54] ICE SKATING SIMULATOR APPARATUS AND METHOD OF USING SAME

[76] Inventor: Daniel Andrew Cox, 3 Cherokee Ct., Londonderry, N.H. 03053

[21] Appl. No.: 08/939,154

[22] Filed: Sep. 29, 1997

[51] Int. Cl.[6] ..... A63B 69/18; A63B 23/04

[52] U.S. Cl. ..... 482/70; 482/51

[58] Field of Search ..... 482/70, 71, 51, 482/72, 110, 64, 65

[56] References Cited

U.S. PATENT DOCUMENTS

| | | | |
|---|---|---|---|
| 3,707,283 | 12/1972 | Cormier | 482/71 |
| 3,756,595 | 9/1973 | Hague | 482/51 |
| 3,807,727 | 4/1974 | Ferguson | 482/71 |
| 4,607,839 | 8/1986 | Knudson | 482/71 |
| 4,781,372 | 11/1988 | McCormack | 482/71 |
| 4,811,941 | 3/1989 | Elo | 482/71 |
| 4,844,450 | 7/1989 | Rodgers | 482/110 X |
| 4,993,704 | 2/1991 | Luczynski | 482/71 X |
| 5,316,530 | 5/1994 | Romer | 482/71 |
| 5,391,130 | 2/1995 | Green | 482/71 |
| 5,718,658 | 2/1998 | Miller | 482/51 X |

FOREIGN PATENT DOCUMENTS

| | | | |
|---|---|---|---|
| 1412-796 | 7/1988 | U.S.S.R. | 482/71 |
| 1533-710 | 1/1990 | U.S.S.R. | 482/71 |
| WO 94/09858 | 5/1994 | WIPO | 482/70 |

*Primary Examiner*—Stephen R. Crow
*Assistant Examiner*—William LaMarca

[57] ABSTRACT

A skating apparatus, for facilitating replication of a skating stride, comprising a support surface with a pair of pivotable simulator arms. Each pivotable simulator arm supports a foot portion which is slidable along the pivotable simulator arm in a guide track. The foot portions are coupled to a resistance mechanism, via a chain, to provide resistance to the foot portions during a skating stride. The resistance mechanism includes a retraction device for retracting a chain during the return stroke of the foot portion.

14 Claims, 4 Drawing Sheets

ICE SKATING SIMULATOR APPARATUS AND METHOD OF USING SAME

FIELD OF THE INVENTION

This invention relates to an improved apparatus for simulating ice skating motion for off season skate training and/or to facilitate rehabilitation of an injured skater.

BACKGROUND OF THE INVENTION

There are a variety of known ice skating apparatuses which have attempted to simulate the precise ice skating motion for a skater to provide rehabilitation to an injured skater and/or to assist a skater with off season training, e.g. allow the skater to simulate or replicate an ice skating stride so that a workout can be achieved without an ice surface and without a pair of skates.

The inventor is aware of the following United States patents, namely:

| | |
|---|---|
| 4,340,214 | SchÜtzer |
| 4,781,372 | McCormack |
| 4,811,941 | Elo |
| 4,915,373 | Walker |
| 5,222,928 | Yacullo |
| 5,284,460 | Miller et.al. |
| 5,290,211 | Stearns |
| 5,328,427 | Sleamaker |

SUMMARY OF THE INVENTION

Wherefore, it is an object of the present invention to overcome the aforementioned problems and drawbacks associated with the prior art designs.

Another object of the invention is to provide an apparatus which accurately simulates the ice skating motion of a skater so that each and every muscle required for skating can be properly exercised.

Further object of the invention is to provide an apparatus which is relatively inexpensive to manufacture, simple to maintain but is reliable and easy to use.

Still another object of the invention is to provide an apparatus which provides a suitable resistance while the skater is making a skating stride but only provides minimal resistance when the skater is repositioning his/her leg for a further skating stride.

Yet another object of the invention is to provide the ability to have a longer, more intense workout section while allowing a full range of motion thereby facilitating improved strength, flexibility and endurance training.

The present invention relates to a skating simulator apparatus, for facilitating replication of a skating stride, said skating simulator apparatus comprising a base having a pair of simulator arms pivotally supported on a top surface thereof; each of said pivoted simulator arms having a track extending axially along a portion thereof, and a foot platform being supported by each said pivoted simulator arm and being slidable axially along said track; a resistance mechanism being provided for supplying resistance to said foot platform during use of said skating simulator apparatus; and each said foot platform being coupled to said resistance mechanism, by an elongate flexible member, to transfer motion from said foot platform, along said track, into resistance motion experienced by the user during use of said skating simulator apparatus.

The present invention also relates to a method of replicating a skating stride, said method comprising the steps of:

pivoting a pair of simulator arms to a top surface of a base; providing each of said pivoted simulator arms with a track extending axially along a portion of each said pivoted simulator arm; supporting a foot platform on each said pivoted simulator arm such that said foot platform being slidable axially along said track; providing a resistance mechanism for supplying resistance to said foot platform during use of said skating simulator apparatus; and coupling each said foot platform to said resistance mechanism, by an elongate flexible member, to facilitate transferring motion of said foot platform, along said track, into resistance motion experienced by the user during use of said skating simulator apparatus.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
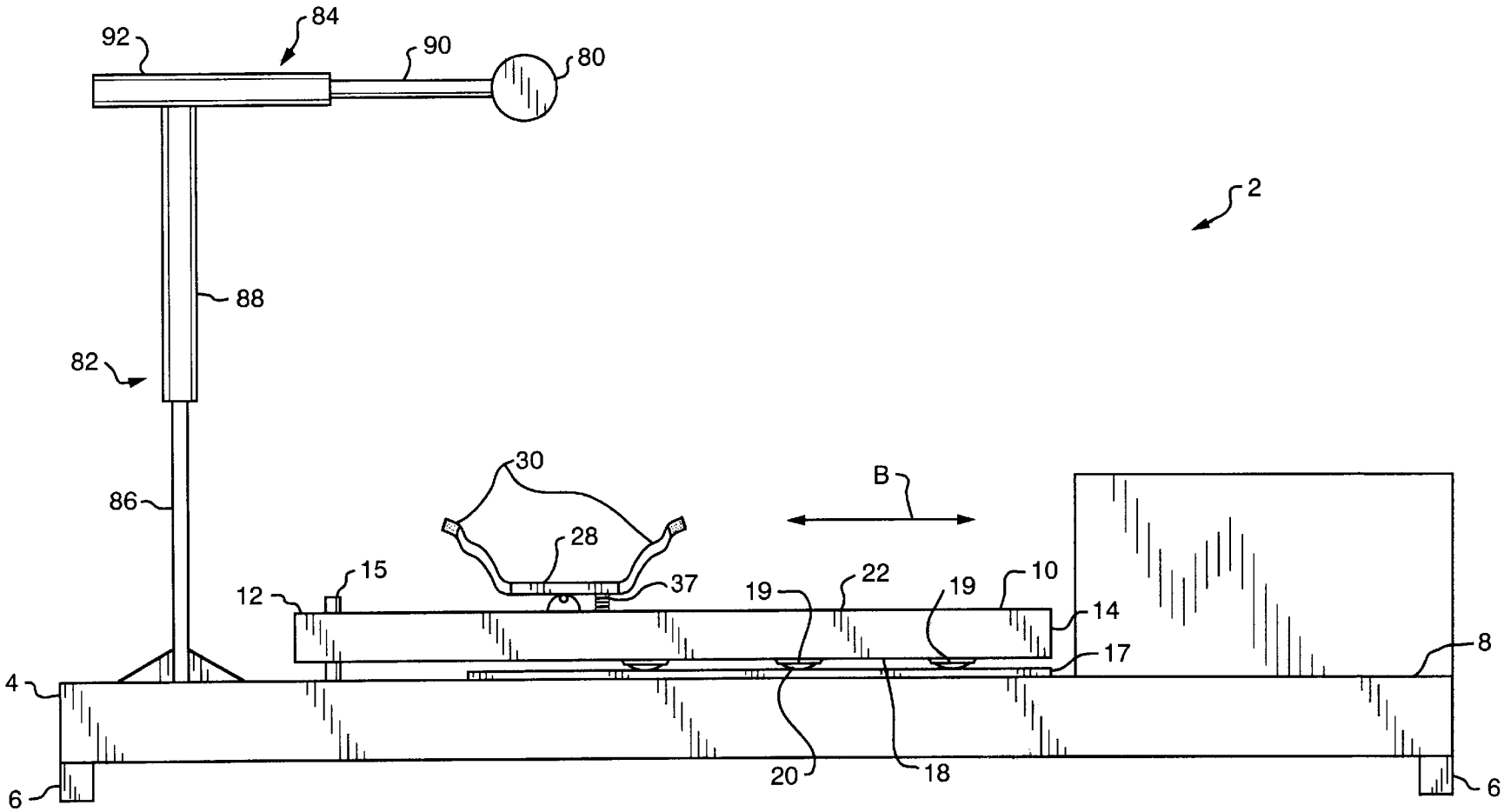
FIG. 1 is a diagrammatic side elevational view of the skating simulator according to the present invention.
Figure 2:
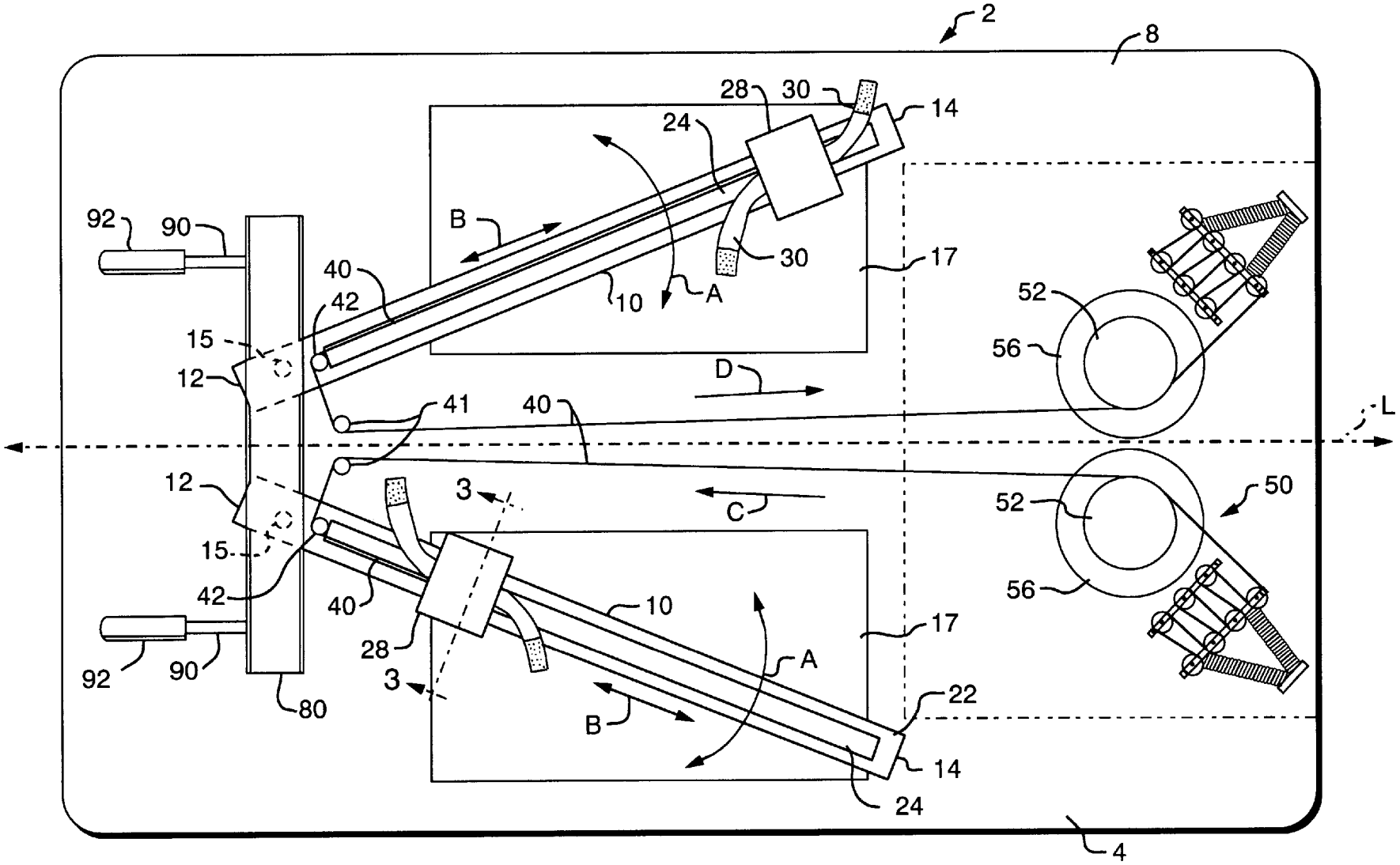
FIG. 2 is a diagrammatic top plan view of the skating simulator of FIG. 1 with the cover removed for the purpose of clarity.
Figure 3:
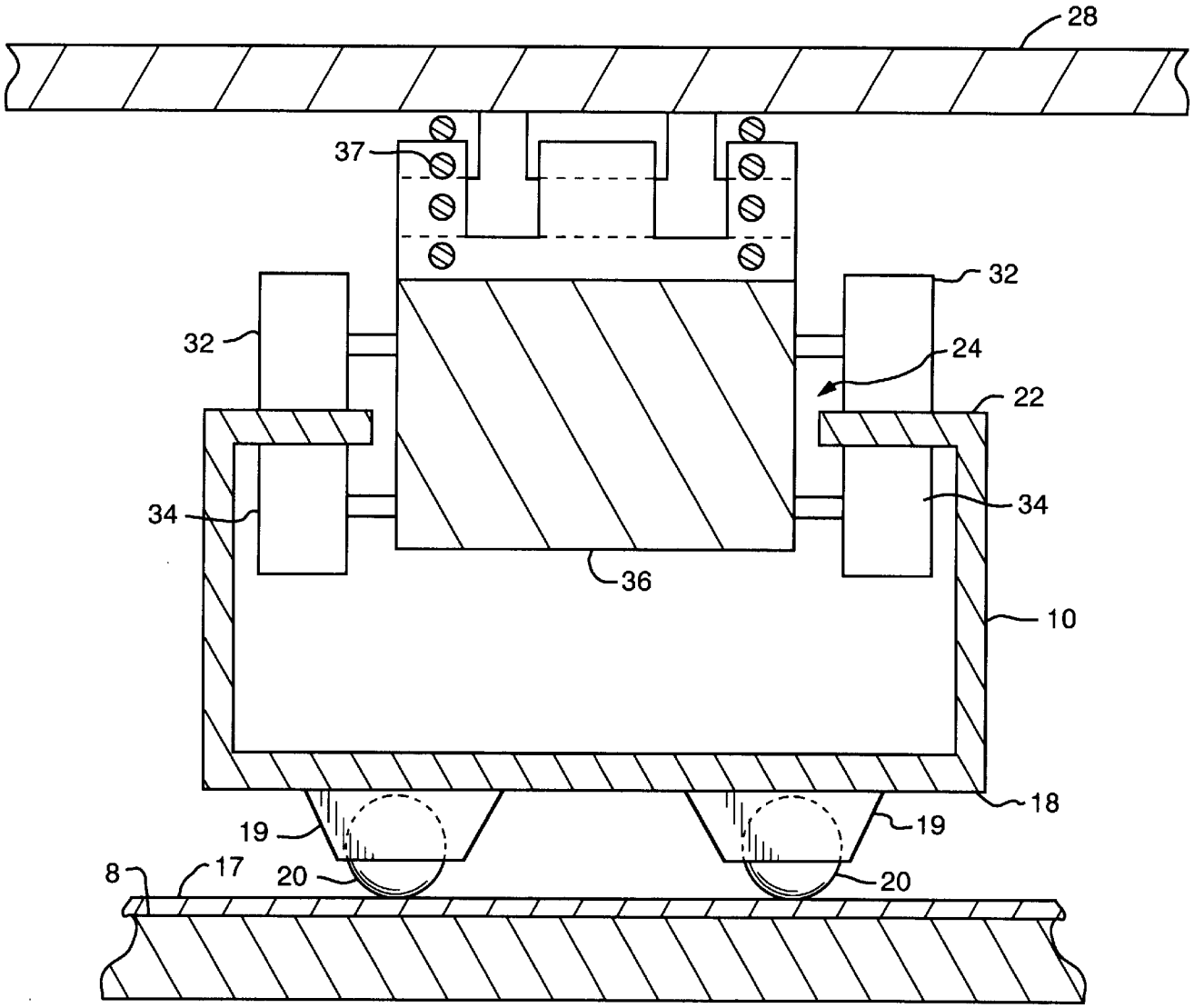
FIG. 3 is a diagrammatic cross-sectional view along section line 3—3 of FIG. 2.

Turning now to FIGS. 1 through 3, a detailed description concerning the present invention will now be provided. As can be seen in those Figures, the skating simulator 2 comprises a support base 4 having a plurality of legs 6, e.g. typically four spaced apart or two opposed elongate legs, which are located under the skating simulator 2 to support the skating simulator 2 on a desired support surface, e.g. a floor. The top surface 8 of the skating simulator 2 supports a pair of spaced apart simulator arms 10. A first end 12 of each of the simulator arms 10 is pivoted, via pivot pin 15, to facilitate pivoting of a second opposite end 14 of the simulator pivot arm 10 in an arcuate fashion. A bearing (not numbered), surrounding pivot pin 15, facilitates pivoting of the second opposed free end 14 of the simulator pivot arm 10.

As can be seen more clearly in FIG. 2, the top surface 8 of the support base 4 is provided with an antifriction surface 17, e.g. a TEFLON plate, or some other low resistent friction material which is adhesively fastened or otherwise permanently secured to the top surface 8 to the area where the simulator pivot arm 10 is allowed to move in an arcuate fashion.

A base surface 18 of each simulator pivot arm 10 supports a plurality of conventional rollers or ball bearings 20 which are captively retainment in a housing 19 supported by the base surface 18 in a conventional manner. The captive retainment of the rollers or ball bearings 20 is such that the retainment allows the rollers or ball bearings 20 to roll, with minimal friction, and thereby allow the simulator pivot arm 10 to pivot in either direction along arc A, about pivot pin 15, on the antifriction surface 17.

The top surface 22 of each simulator pivot arm 10 is provided with an elongate slot or track 24 which commences adjacent the first end 12 and extends to the free end 14 of the simulator pivot arm 10. The track is T-shaped in transverse cross section which has a portion located between the top surface 22 and the base surface 18, as can be seen more clearly in FIG. 3. Each one of the simulator pivot arm 10 also carries a foot platform 28 having a two piece strap member 30 for engaging and securing a foot or shoe of a user to the foot platform 28 in a conventional manner. The strap member 30 comprises two pieces each carrying one portion of a mating male and female releasable interlocking component, e.g. a pair of touch fasteners, or any other conventional fastener for securely fastening the foot or shoe of a user to a top surface of the foot platform 28. As such securement feature is well known to those skilled in this art, a further detailed description concerning the same is not provided herein. Foot platform 28 is pivoted to a platform framework 36 to allow limited pivoting of the foot platform 28 relative thereto. At least one spring 37 biases the foot platform 28 toward a substantially horizontally position and cushions the foot during a skating stride, perferably one either side of the platform framework 36, as will be described in further detail herein after.

The foot platform 28 includes a platform framework 36 which carry four spaced apart first rollers 32 (only two of which are shown in FIG. 3), which ride along the outwardly facing top surface 22, and four spaced apart second rollers 34 (only two of which are shown in FIG. 3), which ride along an inwardly facing surface of the top surface 22. The eight rollers combine with one another to sandwich the top surface 22 therebetween while still allowing the foot platform 28 to move to and fro axially along the track 24 in the direction of arrows B. A further detailed discussion concerning operation of the foot platforms 28 during use of the skating simulator 2 will be provided below.

The end of the platform framework 36, facing the first end 12 of the simulator pivot arm 10, is provided with a conventional coupling 38 (not shown), e.g. an attached ring or bolt for example. The coupling, in turn, is connected to a first end of a chain 40. The chain 40 extends through a central aperture, formed in the simulator pivot arm 10 and comprising part of the T-shaped track 24, and engages with and partially wraps around a first gear 42. The chain 40 then partially wraps around a second gear 41 and extends along a central longitudinal axis L of the skating simulator 2 to a free wheel arrangement 50 and engages with and partially wraps around a first free wheel gear 52. Finally, the chain terminates by being connected to a pulley arrangement 60 supported by a framework 57 of the skating simulator 2.

The free wheel gear 52 of the free wheel arrangement 50, when rotated in the direction of arrow C, is coupled, via a conventional free wheel connection (not shown further detail in the drawings), to a weighted wheel 56 and imparts rotary motion to the weighted wheel 56. When the first free wheel gear 52 is rotated in the opposite direction, depicted by arrow D, the free wheel gear 52 is allowed to move or rotate relative to the weighted wheel 56 with a very slight or only minimal frictional resistance. Accordingly, movement of the chain 40 in a first direction, i.e. in the direction of arrow C, imparts rotary motion to the weighted wheel 56 while movement in the opposite direction, i.e. in the direction of arrow D, does not impart such rotary motion or energy to the weighted wheel 56. As such "free wheel" feature is well known to those skilled in this art and forms not part of the invention per se, a further detailed description concerning the same is not provided herein.

Prior to the chain 40 being coupled to the coupling 54 of the skating simulator 2, the chain 40 passes through a pulley arrangement 60 (FIG. 4), which comprises a plurality of first pulleys 62 which are firmly connected, via a frame work 64, to the skating simulator 2. The pulley arrangement 60 also comprises a plurality of second pulleys 66 which are connected to a free floating and movable frame work 68 and the chain 40 passes therethrough. The movable frame work 68 is, in turn, connected to a framework 57 of the skating simulator 2, via an expansion/contraction device, such as one or two tensioning springs 70. The pulley arrangement 60 facilitates feeding as well as a retraction the chain 40, during use of the skating simulator 2, and a further detailed description concerning the same will be provided below.

A hand or chest engagement stabilizer bar 80 is provided on a front portion of the top surface 8 of the skating simulator 2. The stabilizer bar 80 is supported by one and preferably a pair of vertically extending rods 82 which are each firmly attached, at one end thereof, to the support base 4 of the skating simulator 2. The opposite end of the vertical rods 82 support a pair of horizontally arranged bars 84. The pair of vertically extending rods 82 each comprise a pair of first and second member 86, 88 with the first member 86 being telescopically received with in the second member 88 to facilitate a length adjustment of the first and second members 86, 88 and thereby adjust the spacing of the horizontally arranged bar 84 relative to the top surface 8 of the skating simulator 2. As such locking adjustment is conventional and well known in the art, and forms no part of the invention per se, a further detailed description concerning the same is not provided.

The vertically extending rods 82 are coupled to the stabilizer bar 80 by preferably a pair of extending horizontal rods 84 which are each firmly attached, at one end thereof, to the free end of the vertically extending rods 82. The opposite end of the horizontal extending rods 84 support the stabilizer bar 80. The pair of horizontal extending rods 84 each comprise a pair of first and second member 90, 92 with the first member 90 being telescopically received with in the second member 92 to facilitate a length adjustment of the first and second members 90, 92 and thereby adjust the spacing of the stabilizer bar 80 relative to the vertical extending bars 82 of the skating simulator 2. As such adjustment feature is well known in the art, and forms no part of the invention per se, a further detailed description concerning the same is not provided.

It is to be appreciated that the stabilizer bar 80 can be provided with a suitable padding, if desired, to facilitate use. During use, the user either grabs the stabilizer bar 80 with his/her hands or the stabilizer bar 80 is adjusted, by the above described adjustment mechanisms, to rest against the chest or waist of the user so that the upper portion of the user remains stationary during skating strides while using the skating simulator 2.

As both of the simulator pivot arms 10 operate identically, a further detailed description concerning only one of the simulator pivot arms 10, and its corresponding components, will now be provided.

In order to use the present invention, a user first places one of his/her feet on one of the foot platforms 28, e.g. the left foot platforms 28, and secures his/her feet foot thereto by use of the strap member 30. The user then repeats the same procedure with the other foot being placed on the second foot platform 28, e.g. the right foot platforms 28, utilizing the other strap member 30. Thereafter, the user places his/her hand, if desired or necessary, on the stabilizer bar 80 and then is able to commence a workout or other exercise. Specifically, the user will first make a skating stride with one of his/her legs, e.g. the left leg, which causes the foot platform 28 to be moved along the track 24 of the simulator pivot arm 10 in a direction away from the first end 12 toward the second end 14, i.e. in the direction of arrow B. As a result of this movement, the rollers 32 and 34, engaged with the inwardly and the outwardly facing surfaces of the top surface 22 of the simulator pivot arm 10 and roll therealong and allow the foot platform 28 to move longitudinally and axially along the track 24. This motion, in turn, also causes the chain 40 to be pulled with the foot platform 28 in the direction of arrow B.

Figure 4:
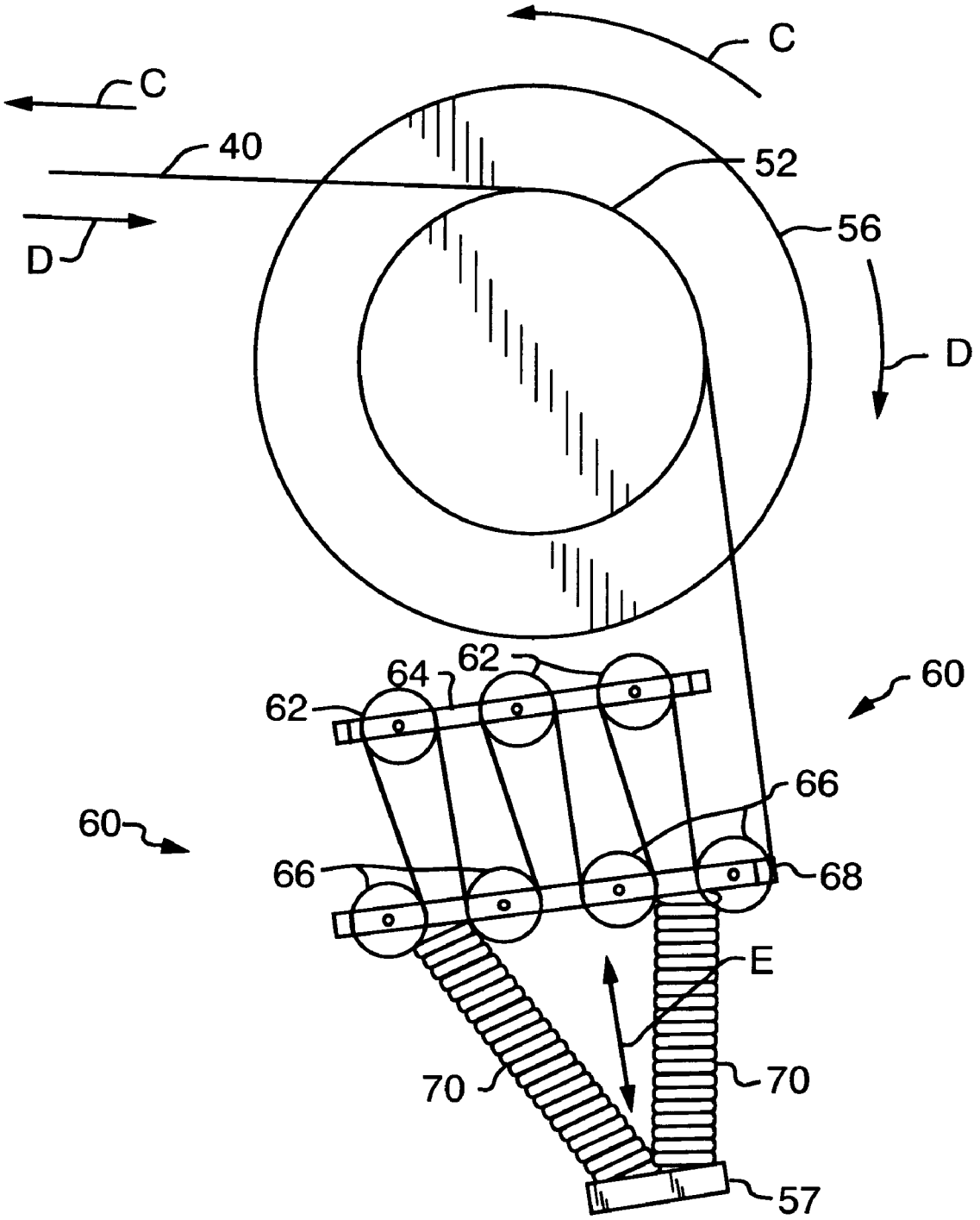
FIG. 4 is a diagrammatic view showing how momentum is transferred to the freewheel arrangement of the skating apparatus during a skating stride.

As a result of this, the second end of the chain 40 is moved in the direction of arrow C and this movement causes the first and second gears 41, 42 to rotate counterclockwise, as can be seen in FIG. 4 of the drawings. This, in turn, causes the free wheel gear 52 to rotate counterclockwise and impart rotational energy to the weighted wheel 56. Due to movement of the chain 40 in the direction of arrow C, the pulley arrangement 60 allows additional chain 40 to be supplied in that direction to facilitate the skating stride. The transfer of energy, via the foot platform 28, the chain 40 and the weight wheel 56, results in suitable resistance being experienced by the user, e.g. suitable resistance being transferred to the legs of the user.

Once the stride of the left leg is substantially completed, the user then commences a stride with the right leg and the same procedure occurs with respect to the second right simulator pivot arm and the associated foot platform 28. Substantially simultaneously or concurrently therewith, the user will return his/her left foot to a position suitable for commencing a further stride with the left leg. During this return stroke, the foot platform 28, carrying the eight rollers 32, 34 which ride along the top surface 22, slides along the track 24 back toward its initial position, i.e. adjacent the first end 12 of the simulator pivot arm 10. This causes the chain 40 to move in the direction of arrow D. As this occurs, the tension springs 70 facilitates take up or retraction of any significant slack occurring in the chain 40 and, in doing so, causes the free wheel gear 52 to "free wheel" with respect to the weighted wheel 56. Once the foot platform 28 is returned to its initial position, by the user, and the pulley arrangement 60 has taken up substantially all of the slack in the chain 40 and the user is ready to commence another skating stride with the left leg and thereby repeat the above described procedure.

It is important to note that the design of the tension spring must be such that it assists with or substantially compensates for most of the generated friction caused by in the roller arrangement of the foot platform 28 and the pivoting motion of the simulator pivot arm 10 so that the user experiences virtually no or very minimal resistance, as typically occurs during a normal skating stride on ice. In addition, the weighted wheel 56 is selected such that its provides a resistance which substantially simulates or duplicates amount of resistance experienced by a conventional skating stride.

It is to be appreciated that the skating simulator can be provided with a braking mechanism, engageable with an exterior surface of the weighted wheel 56, e.g. an adjustable tensioning device. This facilitates providing additional resistance to the weighted wheel 56, if desired, so that the user may be able to adjust the amount of resistance to be experienced. It is also possible to couple or connect the weighted wheel 56 to a computerized system 90 which can be preprogrammed to vary the intensity and/or duration of the workout. As such computerized feature is well known to those skilled in this art, a further detailed description concerning the same is not provided herein.

It is to be appreciated that the resistance mechanism can vary from application to application and virtually any known or convention resistance mechanism, e.g. weighted wheel, frictions elements, springs, etc. could be utilized with the present invention.

Since certain changes may be made in the above described, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. A skating simulator apparatus for facilitating replication of a skating stride comprising:

a support base having a pair of simulator arms freely pivotally supported at one end thereof on a top surface of the base and being movable relative thereto during use of the skating simulator apparatus;

each of the pivoted simulator arms having a track extending axially along a portion thereof and a foot platform being supported by each of the pivoted simulator arms and being slidable along an axial length of the respective track;

a resistance mechanism being provided for supplying resistance to each one of the foot platforms during sliding motion of the foot platform in a direction away from the pivoted end of the pivoted simulator arm;

each of the foot platforms being separately coupled to the resistance mechanism by a separate elongate flexible member to transfer sliding motion of the foot platform along the track in the direction away form the pivoted end of the pivoted simulator arm to the resistance mechanism where the sliding motion is converted into resistance motion experienced by the user moving the foot platform along the track in the direction away form the pivoted end of the pivoted simulator arm; and a simulator arm lower base surface having an intermediate portion that supports at least one bearing member within said intermediate portion which further facilitates pivoting motion of the simulator arms relative to the support base during use of the simulator apparatus.

2. The skating simulator apparatus according to claim 1, wherein the top surface of the support base carries an antifriction material located to engage with the at least one bearing member carried by each of the simulator arms to facilitate pivoting motion of the simulator arms relative to the support base during use of the skating simulator apparatus.

3. The skating simulator apparatus according to claim 1, wherein each of the foot platforms is supported by a respective one of the pivoted simulator arms, via a bearing mechanism, to facilitate to and fro sliding movement of the foot platform along the track of the pivoted simulator arm.

4. The skating simulator apparatus according to claim 1 wherein the resistance mechanism comprises: a weighted wheel which is coupled to a free wheel gear upon rotation in a first direction of the free wheel gear by the elongate flexible member thereby imparting resistance and upon rotation of the free wheel gear in the opposite direction the weighted wheel rotates freely relative to the free wheel gear in a resistance free state.

5. The skating simulator apparatus according to claim 4, wherein the resistance mechanism includes a tensioning mechanism to maintain a suitable tension for each one of the elongate flexible members and facilitate retraction of each one of the elongate flexible members and the associated foot platform as the foot platform is moved along the track in a direction toward the pivoted end of the pivoted simulator arm.

6. The skating simulator apparatus according to claim 1, wherein a stabilizer bar is supported by the base of the skating simulator at a location adjacent the pivoted connection of the pair of simulator arms to the top surface of the base.

7. The skating simulator apparatus according to claim 6, wherein the stabilizer bar is supported by at least one vertically extending rod which is firmly attached, at one end thereof, to the base of the skating simulator, and the opposite end of the vertical rod supports at least one horizontally arranged bar which, in turn, supports the stabilizer bar.

8. The skating simulator apparatus according to claim 6, wherein the stabilizer bar is provided with a padding.

9. The skating simulator apparatus according to claim 1, wherein the pair of simulator arms are each pivoted to the skating simulator apparatus at one end thereof.

10. The skating simulator apparatus according to claim 2 wherein the at least one bearing is captively retained by the simulator arm lower base surface and the antifriction material is permanently secured to the top surface of the support base.

11. The skating simulator apparatus according to claim 3, wherein the bearing mechanism of the foot platform rolls on both an inwardly facing surface and an outwardly facing surface of the simulator arm to facilitate the to and fro sliding movement of the foot platform along the track of the pivoted simulator arm.

12. The skating simulator apparatus according to claim 1, wherein each foot platform has an associated spring device which, during a skating stride of a user, is at least partially compressed by the user, and the spring device, during a return skating stride of the user, re-expands back to its initial position and thereby biases the foot platform back into an initial position to facilitate use of the skating simulator apparatus.

13. A method of replicating a skating stride comprising the steps of:

providing a skating simulator apparatus and freely pivotally supporting a pair of simulator arms at one end thereof to a top surface of a support base such that each simulator arm is movable relative to the support base during use of the skating simulator apparatus;

providing each of the pivoted simulator arms with a track extending axially along a portion thereof, and supporting a foot platform by each one of the pivoted simulator arms such that the foot platform is slidable along an axial length of the respective track;

coupling a resistance mechanism to each one of the foot platforms to supply resistance to each one of the foot platforms to supply resistance to each one of the foot platforms during sliding motion of the foot platforms in a direction away form the pivoted end of the pivoted simulator arms;

each of the foot platforms being separately coupled to the resistance mechanism by a separate elongate flexible member to transfer sliding motion of the foot platform along the track in the direction away from the pivoted end of the pivoted simulator arm to the resistance mechanism where the sliding motion is converted into resistance motion experienced by the user moving the foot platform along the track in the direction away from the pivoted end of the pivoted simulator arm; and supporting at least one bearing member on an intermediate portion of a simulator arm lower base surface which further facilitates pivoting motion of the simulator arms relative to the support base during use of the skating simulator apparatus.

14. The method according to claim 13, further comprising the step supporting an antifriction material on the top surface of the support base at a location to engage with the at least one bearing member carried by each of the simulator arms to facilitate pivoting motion of the simulator arms relative to the base during use of the skating simulator apparatus.

* * * * *